US009717941B2

(12) United States Patent
Gagnon et al.

(10) Patent No.: US 9,717,941 B2
(45) Date of Patent: Aug. 1, 2017

(54) EXERCISE DEVICE

(71) Applicants: Sean Gagnon, Bernardsville, NJ (US); Michael Glen Ritter, Mt. Laurel, NJ (US); Don Brown, Williamsport, PA (US)

(72) Inventors: Sean Gagnon, Bernardsville, NJ (US); Michael Glen Ritter, Mt. Laurel, NJ (US); Don Brown, Williamsport, PA (US)

( * ) Notice: Subject to any disclaimer, the term of this patent is extended or adjusted under 35 U.S.C. 154(b) by 0 days.

(21) Appl. No.: 15/099,153

(22) Filed: Apr. 14, 2016

(65) Prior Publication Data

US 2016/0361585 A1 Dec. 15, 2016

Related U.S. Application Data

(60) Provisional application No. 62/168,702, filed on May 29, 2015.

(51) Int. Cl.
*A63B 21/06* (2006.01)
*A63B 21/00* (2006.01)
(Continued)

(52) U.S. Cl.
CPC ..... *A63B 21/0615* (2013.01); *A63B 21/0728* (2013.01); *A63B 21/4023* (2015.10);
(Continued)

(58) Field of Classification Search
CPC ..... A63B 21/06; A63B 21/0615
(Continued)

(56) References Cited

U.S. PATENT DOCUMENTS 4,854,578 A 8/1989 Fulks
5,788,612 A * 8/1998 Rennick ..... A63B 69/208 482/83

(Continued)

FOREIGN PATENT DOCUMENTS

EP 2586502 A1 5/2013

OTHER PUBLICATIONS

'The Juggernaut Tire'. The Juggernaut Tire, Jul. 25, 2013 (Jul. 25, 2013) [online], [retrieved on Dec. 20, 2016]. Retrieved from the internent: <URL: https://www.youtube.com/watch?v=Ti-8PibR9rU>.

(Continued)

*Primary Examiner* — Andrew S Lo
(74) *Attorney, Agent, or Firm* — Quickpatents, LLC; Kevin Prince

(57) ABSTRACT

An exercise apparatus for use by a person on a support surface comprises a base that includes a bottom side and a top side, the top side having a rigid support mechanism projecting upwardly therefrom. A weight has a first side and a second side and is adapted for rotational engagement with the support mechanism of the base between a first position on one side of the support mechanism and a second position on an opposing side of the support mechanism. Multiple standoffs projecting upwardly from the base are each adapted to contact and support the weight when in either the first position or the second position, defining a gap between the weight and the base to facilitate the gripping of the weight by the person. At least one auxiliary weight support may be included to receive at least one auxiliary weight thereon.

19 Claims, 4 Drawing Sheets

(51) Int. Cl.

| | |
|---|---|
| ***A63B 21/072*** | (2006.01) |
| ***A63B 23/035*** | (2006.01) |
| ***A63B 24/00*** | (2006.01) |
| ***A63B 23/04*** | (2006.01) |
| ***A63B 23/12*** | (2006.01) |

(52) U.S. Cl.
CPC ..... *A63B 21/4035* (2015.10); *A63B 21/4047* (2015.10); *A63B 23/03575* (2013.01); *A63B 23/0405* (2013.01); *A63B 23/1209* (2013.01); *A63B 24/0062* (2013.01); *A63B 21/00065* (2013.01); *A63B 21/151* (2013.01); *A63B 2208/0204* (2013.01); *A63B 2210/00* (2013.01); *A63B 2225/685* (2013.01)

(58) Field of Classification Search
USPC ..... 482/8, 93–94
See application file for complete search history.

(56) References Cited

U.S. PATENT DOCUMENTS

| | | | | |
|---|---|---|---|---|
| 6,022,298 | A | 2/2000 | Svedarsky et al. | |
| 7,976,439 | B2 | 7/2011 | Abelbeck | |
| 8,622,878 | B2 | 1/2014 | Abelbeck | |
| 9,144,704 | B1 | 9/2015 | Abelbeck | |
| 2007/0099777 | A1* | 5/2007 | Forcillo | A63B 21/0615 482/142 |
| 2009/0203499 | A1* | 8/2009 | Svatkova Hoeven | A61H 1/005 482/1 |
| 2010/0285934 | A1* | 11/2010 | Abelbeck | A63B 21/00072 482/97 |
| 2012/0149535 | A1* | 6/2012 | Abelbeck | A63B 21/0724 482/93 |
| 2014/0106942 | A1* | 4/2014 | Abelbeck | A63B 21/0601 482/93 |
| 2014/0256516 | A1* | 9/2014 | Calderone | A61B 5/103 482/98 |
| 2014/0323277 | A1* | 10/2014 | Doane | A63B 21/00047 482/142 |

OTHER PUBLICATIONS

'Klaus Riis Flipping the Tire Flip Machine, about 500kg tire' Klaus Myren Riis, Oct. 26, 2009 (Oct. 26, 2009) [online], [retrieved on Dec. 20, 2016]. Retrieved from the Internet: <URL: https://www.youtube.com/watch?v=kRrLnJEmbkM>.

'Tag Archives: Power Rack' Garage Gyme Guy. Apr. 1, 2014 (Apr. 1, 2014) [online], [retrieved on Dec. 20, 2016]. Retrieved from teh Internet: <URL: https://garagegymguy.com/tag/power-rack/>. Entire document, especially Fig. 3 on p. 5, Fig. 11 on p. 11; para 2 on p. 11.

* cited by examiner

EXERCISE DEVICE

CROSS-REFERENCE TO RELATED APPLICATIONS

This application claims the benefit of U.S. Provisional Patent Application 62/168,702, filed on May 29, 2015, and incorporated herein by reference.

STATEMENT REGARDING FEDERALLY SPONSORED RESEARCH AND DEVELOPMENT

Not Applicable.

FIELD OF THE INVENTION

This invention relates to exercise devices, and more particularly to a weight lifting exercise device.

DISCUSSION OF RELATED ART

So-called "tire flipping" exercises are gaining in popularity and are used principally outdoors or in large, open indoor spaces where there is room to flip a relatively large, weighted tire over onto its other side. However, many gyms and weight rooms do not have enough open space to dedicate to such an exercise, and as a result do not offer such an exercise.

Therefore, there is a need for a device that provides the benefits of a weighted tire-flipping type exercise in a fixed, relatively small space. Such a needed invention would allow for the weight of the object being flipped from one side to another to be adjusted, and would provide for easily gripping of the object. Such a needed device would be intuitive to use, and would be durable and relatively inexpensive to manufacture. The present invention accomplishes these objectives.

SUMMARY OF THE INVENTION

The present device is an exercise apparatus for use by a person on a support surface. The apparatus comprises a base that is adapted for resting on the support surface at a bottom side thereof. A top side of the base has a rigid support mechanism projecting upwardly therefrom.

A weight has at least a first side and a second side. The weight is adapted for rotational engagement with the support mechanism of the base between a first position on one side of the support mechanism, wherein the weight rests with the first side thereof contacting the support surface and/or the base, and a second position on an opposing side of the support mechanism, wherein the weight rests with the second side thereof contacting the support surface and/or the base. Preferably the weight takes the form of one-half of an elastomeric tire, each end of which is fixed with the support mechanism at a weight support bracket.

Preferably the top side of the base includes a plurality of standoffs projecting upwardly therefrom. Each standoff is adapted to contact and support the weight when in either the first position or the second position. As such, a gap is defined between the weight and the base to facilitate the gripping of the weight by the person.

Preferably either the weight or the weight support bracket further includes at least one auxiliary weight support, such as a weight post, adapted to receive at least one auxiliary weight thereon, such as a standard barbell weight. The weight post preferably further includes a locking mechanism that allows selective locking of the auxiliary weight onto the weight post.

In some embodiments, the weight further includes at least one instrument support adapted to receive an electronic instrument, such as a smart phone, adapted to record data of the person using the exercise apparatus. At least one rope tie may be fixed with the support mechanism or the base for facilitating tying of a rope (not shown) to the exercise apparatus for allowing the person to perform rope pulling exercises.

A device that provides the benefits of a weighted tire-flipping type exercise in a fixed, relatively small space. Such a needed invention would allow for the weight of the object being flipped from one side to another to be adjusted, and would provide for easily gripping of the object. Such a needed device would be intuitive to use, and would be durable and relatively inexpensive to manufacture. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
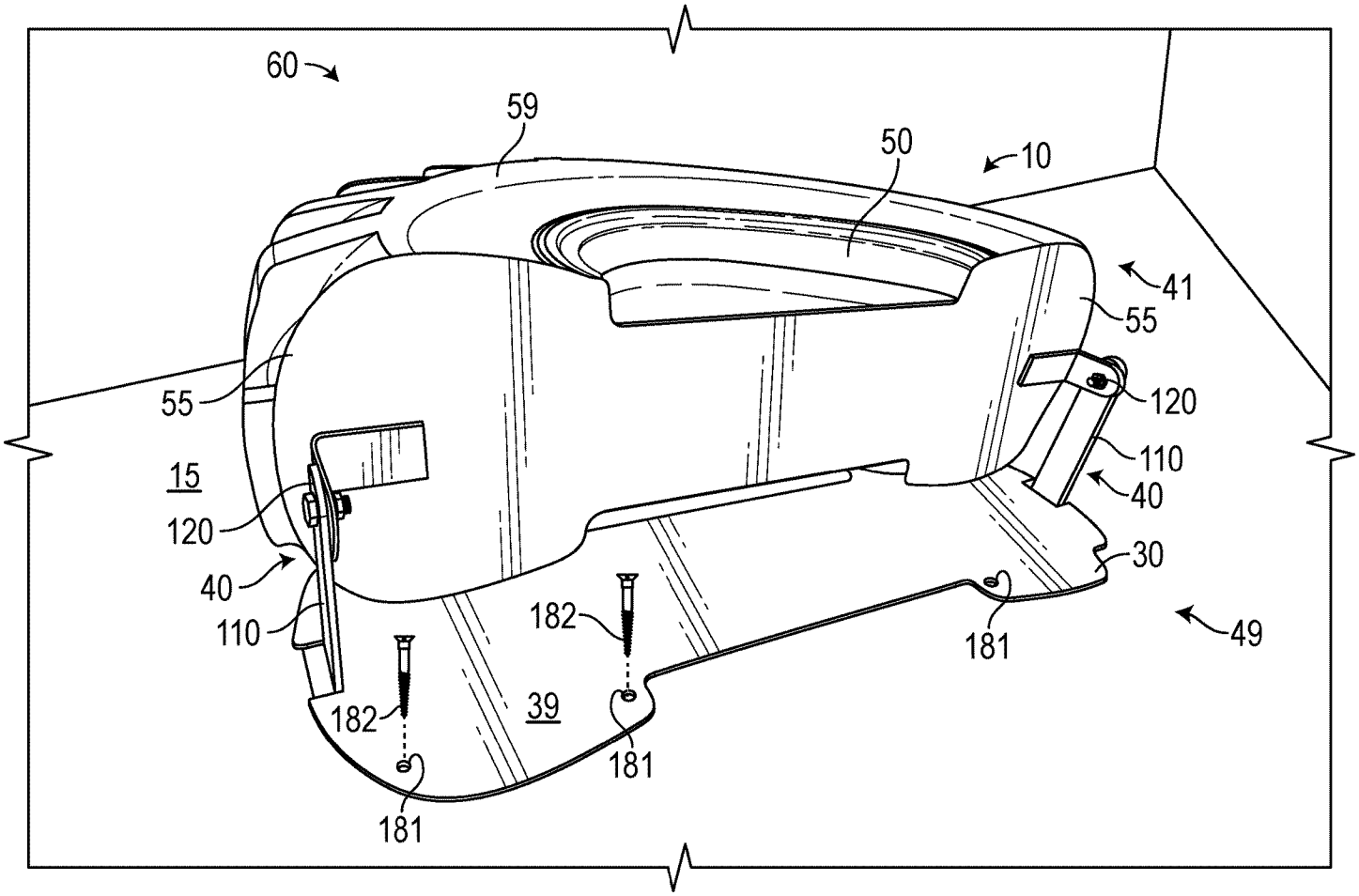
FIG. 1 is a perspective view of the invention, illustrated with a weight in a lowered position.
Figure 2:
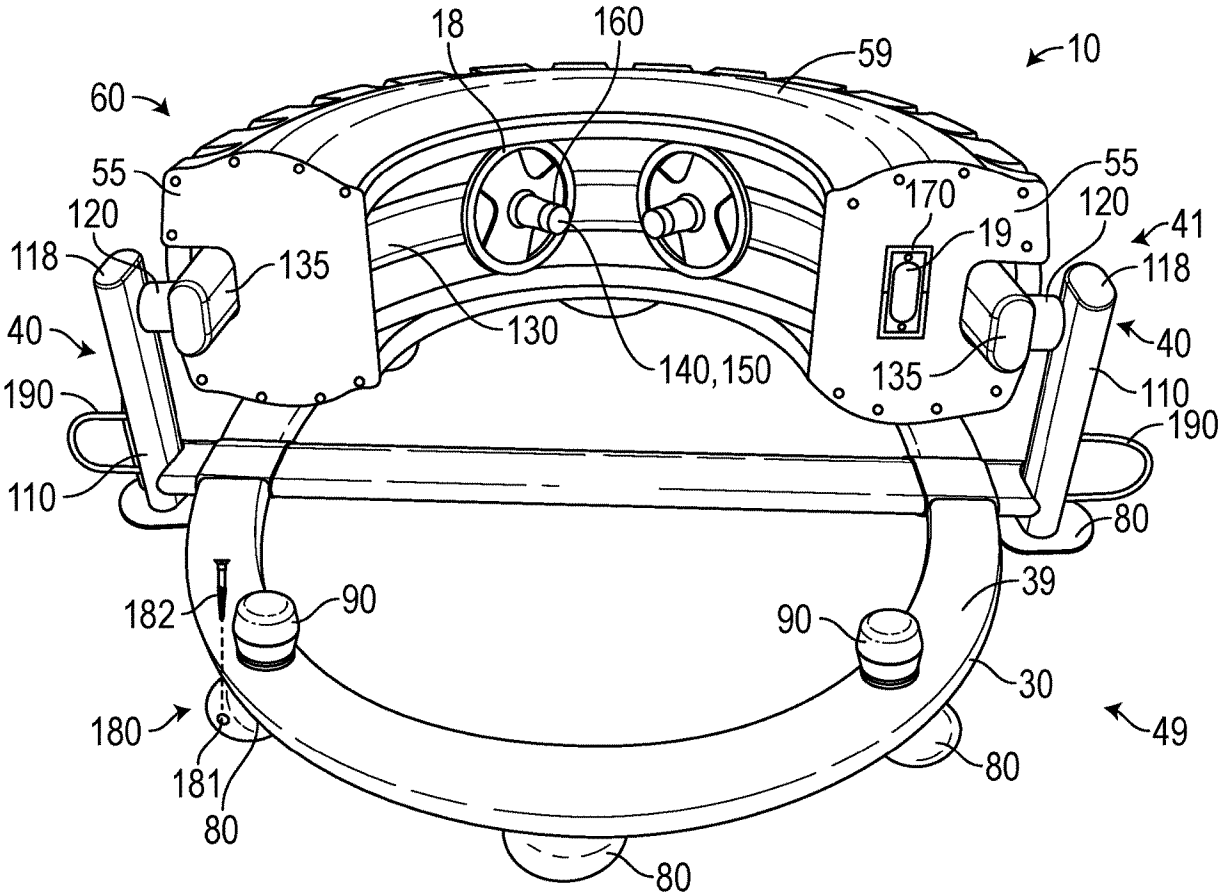
FIG. 2 is a perspective view of an alternate embodiment of the invention.
Figure 3:
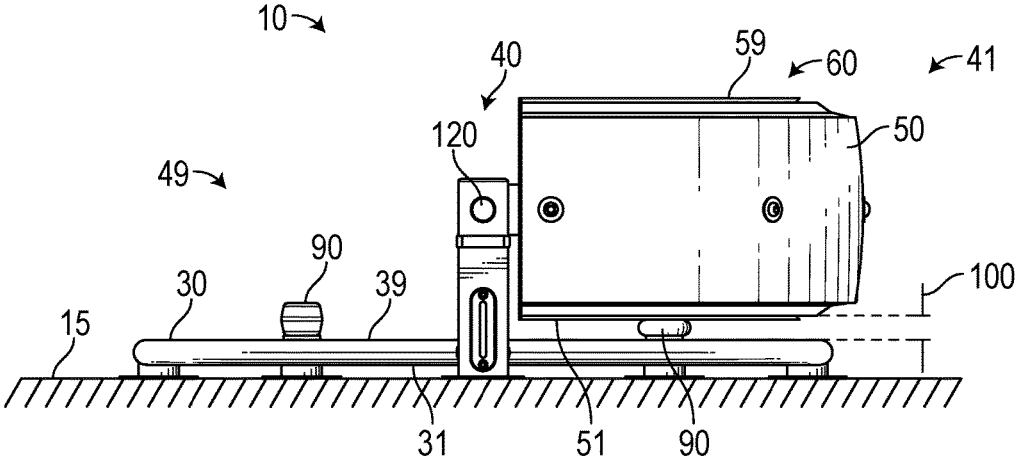
FIG. 3 is a side elevational view of the embodiment of FIG. 2, illustrated with the weight on one side of the apparatus.
Figure 4:
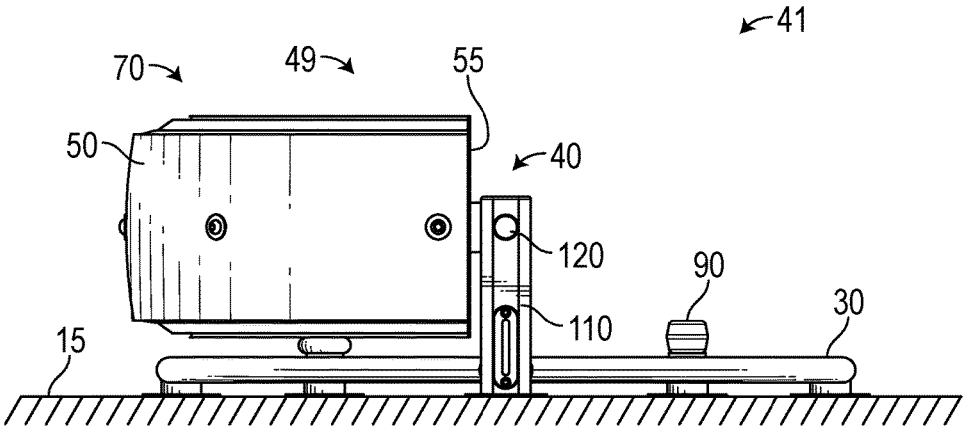
FIG. 4 is a side elevational view of the embodiment of FIG. 2, illustrated with the weight on an opposing side of the apparatus.
Figure 5:
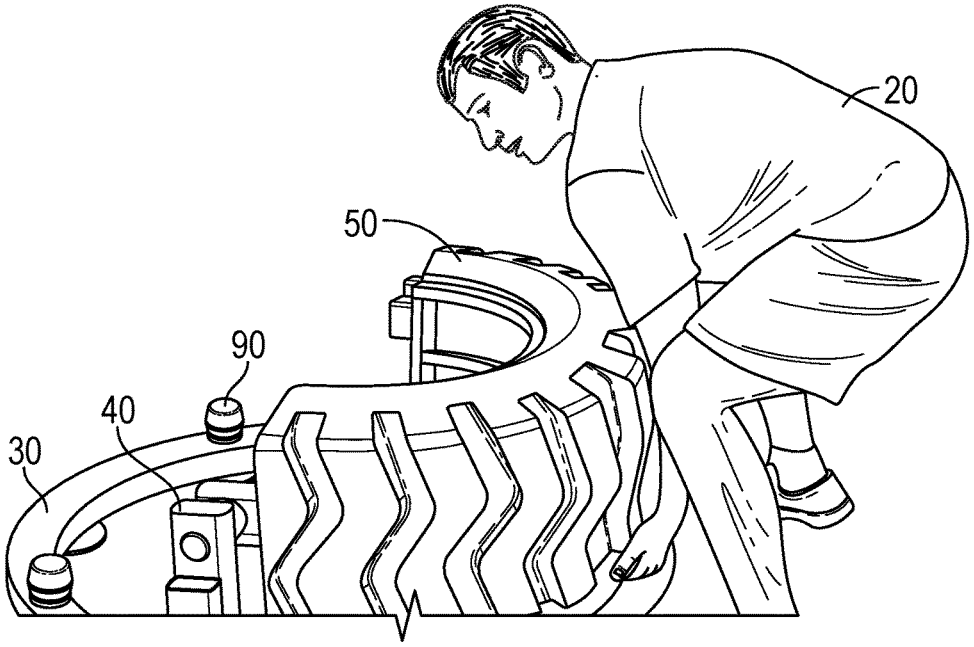
FIG. 5 is a perspective view of the embodiment of FIG. 2, illustrating a person in position to lift the weight of the device.
Figure 6:
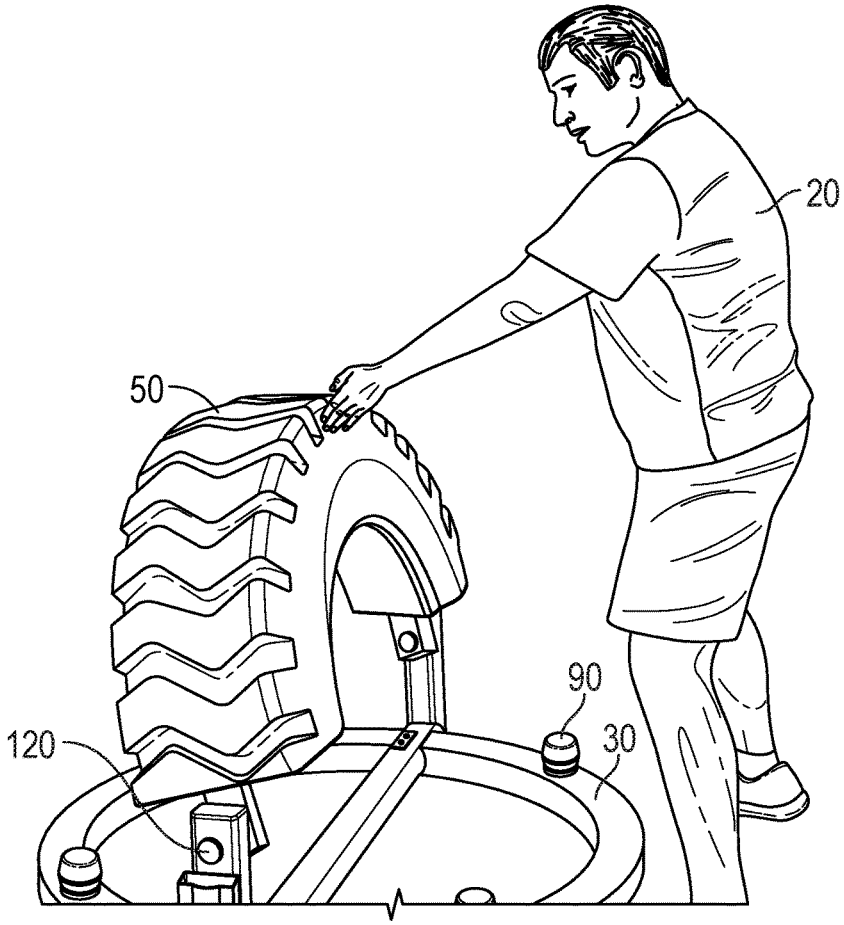
FIG. 6 is a perspective view of the embodiment of FIG. 2, illustrating a person having lifted the weight and the weight flipping over to the opposing side of the apparatus.

FIGS. 1 and 2 illustrate an exercise apparatus 10 for use by a person 20 (FIGS. 5 and 6) on a support surface 15. The apparatus 10 comprises a rigid base 30 that is adapted for resting on the support surface 15 at a bottom side 31 thereof (FIGS. 1, 3 and 4). A top side 39 of the base 30 has a rigid support mechanism 40 projecting upwardly therefrom. The base 30 may further include a mounting system 180 for fixedly mounting the base 30 to the support surface 15, such as at least one aperture 181 through the base 30 and mechanical fasteners 182 for fixing the base 30 to the support surface 15 therewith. The base 30 and support mechanism 40 are both preferably made out of a strong, durable metallic material, but could also be made of wood material or other suitably strong, rigid and durable material.

A weight 50 has at least a first side 51 and a second side 59, preferably each side 51,59 being resilient and integrally formed. The weight 50 is adapted for rotational engagement with the support mechanism 40 of the base 30 between a first position 60 on one side 41 of the support mechanism 40, wherein the weight 50 rests with the first side 51 thereof contacting the support surface 15 and/or the base 30 (FIG. 3), and a second position 70 on an opposing side 49 of the support mechanism 40, wherein the weight 50 rests with the second side 59 thereof contacting the support surface 15 and/or the base 30 (FIG. 4). Preferably the weight 50 takes the form of one-half of an elastomeric tire (FIGS. 5 and 6) having the two ends 55, each end 55 fixed with the support mechanism 40 at a weight support bracket 130 (FIG. 2). Such a weight support bracket 130 is preferably a rigid, semi-circular bracket fixed within the weight 50, each end 135 thereof projecting through one end 55 of the weight 50 for engagement with the support mechanism 40.

In some embodiments the base 30 includes a plurality of feet 80 for contacting the support surface 15 and supporting the base 30 above the support surface 15. Any of the feet 80 may be vertically adjustable such as by screw thread (not shown) to accommodate uneven support surfaces 15 so that the exercise apparatus 10 is level and stable. The base 30 is adapted for supporting the weight 50 above the support surface 15 when the weight is in either the first position 60 or the second position 70. In such an embodiment, at least one of the feet 80 may include the mounting system 180 for fixedly mounting the base 30 to the support surface 15.

Preferably the top side 39 of the base 30 includes a plurality of standoffs 90 projecting upwardly therefrom. Each standoff 90 is adapted to contact and support the weight 50 when in either the first position 60 or the second position 70. As such, a gap 100 is defined between the weight 50 and the base 30 to facilitate the gripping of the weight 50 by the person 20.

In some embodiments the support mechanism 40 includes two upright supports 110 projecting above the top side 39 of the base 30. Each upright support 110 includes at a top end 118 thereof a pivot 120 adapted for engaging opposing sides 55 of the weight 50 and allowing the weight 50 to flip between the first and second positions 60,70. Preferably each upright support 110 is of sufficient height that the weight 50 may rotate at least 180-degrees between the first and second positions 60,70 (FIGS. 3 and 4). In some embodiments (not shown) the exercise apparatus 10 includes only a single upright support 110 projecting above the top side 39 of the base 30, the pivot 120 of which engages a central portion of the weight 50.

Preferably either the weight 50 or the weight support bracket 130 further includes at least one auxiliary weight support 140, such as a weight post 150, adapted to receive at least one auxiliary weight 18 thereon, such as a standard barbell weight (FIG. 2). The weight post 150 is positioned on the weight 50 or the weight support bracket 130 to prevent the auxiliary weight 18 from contacting the base 30 or the support surface 15 when the weight 50 is in or between the first and second positions 60,70. The weight post 150 preferably further includes a locking mechanism 160, such as a locking collar 160, that allows selective locking of the auxiliary weight 18 onto the weight post 150. Alternately the locking mechanism 160 may be a locking pin arrangement (not shown), or the like, as is or becomes known in the art.

In some embodiments, the weight 50 further includes at least one instrument support 170 adapted to receive an electronic instrument 19, such as a smart phone, adapted to record data of the person 20 using the exercise apparatus 10. At least one rope tie 190 (FIG. 2) may be fixed with the support mechanism 40 or the base 30 for facilitating tying of a rope (not shown) to the exercise apparatus for allowing the person 20 to perform rope pulling exercises.

While a particular form of the invention has been illustrated and described, it will be apparent that various modifications can be made without departing from the spirit and scope of the invention. For example, the weight 50 may take the form of something other than a tire. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. An exercise apparatus for use by a person on a support surface, comprising:

a base adapted for resting on the support surface at a bottom side thereof, a top side of the base having a support mechanism projecting upwardly therefrom;

a plurality of standoffs projecting upwardly from the top side; and a weight having at least a first resilient side and a second resilient side, the weight adapted for rotational engagement with the support mechanism of the base between a first position on one side of the support mechanism wherein the weight rests with the first resilient side thereof contacting at least one of the plurality of standoffs, and a second position on an opposing side of the support mechanism wherein the weight rests with the second resilient side thereof contacting at least another of the plurality of standoffs, the plurality of standoffs defining a gap between the first or second resilient side of the weight and the top side of the base to facilitate gripping of the weight by the person.

2. The exercise apparatus of claim 1 wherein the base includes a plurality of feet for contacting the support surface and supporting the base above the support surface, the base adapted for supporting the weight above the support surface when the weight is in either the first or second position.

3. The exercise apparatus of claim 1 wherein the support mechanism includes at least one upright support projecting above the top side of the base, the at least one upright support including at a top end thereof a pivot adapted for engaging the weight and allowing the weight to flip between the first and second positions.

4. The exercise apparatus of claim 3 wherein the support mechanism includes two of the upright supports projecting above the top side of the base, each upright support including at a top end thereof the pivot adapted for engaging opposing sides of the weight and allowing the weight to flip between the first and second positions.

5. The exercise apparatus of claim 3 wherein the first position of the weight is substantially 180-degrees rotated from the second position of the weight.

6. The exercise apparatus of claim 1 wherein the weight takes the form of one-half of a tire having two ends, each end fixed with the support mechanism at a bracket.

7. The exercise apparatus of claim 5 wherein the weight takes the form of one-half of a tire having two ends, each end fixed with the support mechanism at a weight support bracket.

8. The exercise apparatus of claim 7 wherein the weight support bracket is a semi-circular bracket fixed within the weight, each end of the weight support bracket projecting through the weight for engagement with the support mechanism.

9. The exercise apparatus of claim 1 wherein the weight includes at least one auxiliary weight support adapted to receive at least one auxiliary weight thereon.

10. The exercise apparatus of claim 9 wherein the at least one auxiliary weight support is a weight post adapted to receive a barbell weight thereon, the weight post positioned on the weight to prevent the auxiliary weight from contacting the base or the support surface when the weight is in or between the first and second positions, the weight post including a locking mechanism allowing selective locking of the auxiliary weight on the weight post.

11. The exercise apparatus of claim 10 wherein the locking mechanism is a locking collar.

12. The exercise apparatus of claim 8 wherein the weight support bracket includes at least one auxiliary weight support adapted to receive at least one auxiliary weight thereon.

13. The exercise apparatus of claim 12 wherein the at least one auxiliary weight support is a weight post adapted to receive a barbell weight thereon, the weight post positioned on the weight support bracket to prevent the auxiliary weight from contacting the base or the support surface when the weight is in or between the first and second positions, the weight post including a locking collar allowing selective locking of the auxiliary weight on the weight post.

14. The exercise apparatus of claim 1 wherein the weight includes at least one instrument support adapted to receive an electronic instrument adapted to record data of the person using the exercise apparatus.

15. The exercise apparatus of claim 1 wherein the base includes a mounting system for fixedly mounting the base to the support surface.

16. The exercise apparatus of claim 15 wherein the mounting system includes at least one aperture through the base and mechanical fasteners for fixing the base to the support surface therewith.

17. The exercise apparatus of claim 2 wherein at least one of the feet of the base includes a mounting system for fixedly mounting the base to the support surface.

18. The exercise apparatus of claim 17 wherein the mounting system includes at least one aperture through at least one of the feet and mechanical fasteners for fixing the feet to the support surface therewith.

19. The exercise apparatus of claim 1 wherein the first and second resilient sides of the weight are integrally formed.

* * * * *